US005806983A

United States Patent [19]

Millon et al.

[11] Patent Number: 5,806,983

[45] **Date of Patent: *Sep. 15, 1998**

[54] POUCH HAVING RADIO FREQUENCY ENERGY SEALABLE LAYER

[75] Inventors: Joel Millon, Westfield; Quang Nguyen, Piscataway; Viren Trivedi, Belle Mead; Todd Van Gordon, Basking Ridge, all of N.J.; John Swanson, Newtown, Pa.

[73] Assignee: Colgate-Palmolive Company, New York, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 676,044

[22] Filed: Jul. 5, 1996

[51] Int. Cl.[6] ..... B65D 30/08; B65D 30/26; B65D 33/38

[52] U.S. Cl. ..... 383/113; 383/906

[58] Field of Search ..... 383/105, 113, 383/115, 906; 222/107; 53/DIG. 2

[56] References Cited

U.S. PATENT DOCUMENTS

| | | |
|---|---|---|
| Re. 27,838 | 12/1973 | Leasure et al. . |
| 2,866,488 | 3/1958 | Thompson . |
| 3,248,040 | 4/1966 | Friedman . |
| 3,415,286 | 12/1968 | Arnold . |
| 4,235,365 | 11/1980 | Yoshii et al. . |
| 4,543,279 | 9/1985 | Kai . |
| 5,222,813 | 6/1993 | Kopp et al. . |

FOREIGN PATENT DOCUMENTS

| | | |
|---|---|---|
| 1154361 | 4/1958 | France . |
| 2639325 | 5/1990 | France . |
| 6179461 | 6/1994 | Japan . |
| 2278338 | 11/1994 | United Kingdom . |
| 2292114A | 2/1996 | United Kingdom . |

*Primary Examiner*—Horace M. Culver
*Attorney, Agent, or Firm*—Michael McGreal

[57] ABSTRACT

A pouch package is formed that has a multilayer structure of two or more layers where the longitudinal seal is formed from a bonding of the inner layer to the inner layer in a fin seal arrangement. One layer of the multilayer structure is a seal layer and another layer a barrier layer. There can be additional layers such as additional barrier layers and cutter lubricant layers. It is preferred that the multilayer structure have two to four layers (not counting adhesive tie layers) and that the inner seal layer be readily sealable by means of radio frequency energy. The longitudinal seal will preferably be along a side surface so as to have a spout. The pouch is made on form/fill equipment from a multilayer sheet by the multilayer sheet being formed into a tubular member with a longitudinal seal. A lower seal then is formed, the pouch filled and severed from the adjacent tubular member The pouch will contain products such as bleaches, fabric softeners, soaps, glass cleaners and bath and shower gels and lotions.

12 Claims, 2 Drawing Sheets

POUCH HAVING RADIO FREQUENCY ENERGY SEALABLE LAYER

BACKGROUND OF THE INVENTION

This invention relates to a pouch package for liquid and solid products where the pouch is made from a single coextruded or laminate multilayer film and has a longitudinal fin seal. More particularly, this invention relates to a film that has as an inner seal layer that can be activated by radio frequency energy and a barrier layer primarily for organic components of a product that are contained in the pouch.

Pouches are used for the packaging of many products around the world. One reason is that they are easily formed and filled. Another reason is that they use very little plastic in the packaging and from this point of view are considered to be an environmentally preferred package. Pouches in 250 ml and 500 ml sizes are used to contain liquid soaps, bleaches, fabric softeners, glass cleaners, floor cleaners and various automobile cleaning products. In many instances the pouches contain a concentrated product which is poured into a larger bottle with water added to dilute the concentrate and to fill the bottle. Pouches also have the advantages that they require little space and can be more easily stocked and sold by small grocery stores and convenience stores. After use they can be easily rolled or folded into a small pack and discarded.

Various pouches are currently in use. One is the pouch of Cotelle S.A. a French company. The pouches are primarily used to package bleaches and fabric softeners in a concentrated condition. The pouches have a recess a short distance below the upper edge of the pouch to define a spout. In order to use the package the end part of the spout is cut-away and the pouch emptied through the opening. The contained liquid will be a concentrate so the contents will be poured into a bottle and water added to fill the bottle. The pouch package is folded or rolled into a small pack and discarded.

The pouches are conveniently made and filled on form/fill equipment. In this type of equipment the pouch is made from the sheet of multilayer film and filled in a continuous sequence. The multilayer film is fed into the form/fill equipment from a feed roll and is shaped into a tubular member with the longitudinal edges are sealed in an overlap seal arrangement of the inner layer bonding to the outer layer. The lower end of the tubular member is then sealed. The next sequence is for a product to be flowed into the pouch and the other end of the pouch to be sealed. After the other end of the pouch is sealed, the pouch is severed from the tubular member. This is done at the same time as the lower end of the next pouch is being formed from tubular stock. In this way the pouches are continuously formed and filled with a product. They then are case packed and shipped.

Another technique for making pouch packages is to use two sheets of film. The two sheets are bonded together at the edges to form a tubular form which then is filled and divided into pouches in a separate apparatus. In this pouch there is a seal of inner layer to inner layer on all edges. However, this pouch since it has two longitudinal seals will have additional points for a potential failure. It is preferred to have fewer seals since pouches usually will fail at a seal.

The pouches that are made according to this invention preferably are sealed using radio frequency (RF) energy. The use of RF energy is preferred since this permits the formation of the recess near the as the lower seal is being formed in nthe form/fill operation. In the use of RF energy the inner layer must absorb RF energy converting it to heat. Ultrasonic heating and direct heat sealing can be used but it will be difficult the recess that is described above and the resulting spout that defines the space between the spout and the nearby edge of the pouch.

The present invention solves various problems in the manufacture of pouches. It allows the use of a two layer film to make the pouch. There need only be a seal layer and a barrier layer. Other layers such as a lubricant layer can be used. The seal layer also will have certain barrier properties in addition to the sealing properties.

BRIEF DESCRIPTION OF THE INVENTION

The present invention is directed to a pouch package that is comprised of a multilayer film an inner seal layer and adjacent to the seal layer, a barrier layer, and preferably an organic barrier layer. Adjacent to the opposite side of the barrier layer can be a lubricant layer for lubricating the cutter when the formed pouches are severed to individual units. The pouch packages will have an inner layer to inner layer seal which is termed in this application a fin seal. This is a seal of a like material to a like material.

The multilayer film will have a thickness of about 120 microns to about 400 microns, and preferably about 180 microns to about 320 microns. The seal layer will have a thickness of about 10 microns to about 80 microns, and preferably about 15 microns to about 50 microns. The barrier layer will have a thickness of about 20 microns to about 100 microns and preferably about 30 microns to about 70 microns. There also can be adhesive tie layers between the seal and barrier layer and the barrier layer and another layer, such as a lubricant layer. Such layers will have a thickness of about 5 microns to about 15 microns, and preferably about 10 microns.

The pouches are formed in a form/fill process. The film multilayer is fed into a form/fill machine and formed into a tubular member. This tubular member is formed having a longitudinal seal, and in the present pouches, an inner layer to inner layer fin seal. A lower seal then is made and the pouch filled. At the time that the lower seal is made the recess is formed to thereby produce the spout. The most effective way to make this recess and spout is through the use of RF energy at the time of making the seal. The other end of the pouch after filling is sealed and and the pouch severed from the tubular member to which it is attached.

The seal layer is comprised of a material which softens upon the application of RF energy. These can be ethylene vinyl acetate copolymers and acrylic acid copolymers such as ethylene acrylic acid copolymers and methacrylic acid copolymers. Barrier layers can be polyethylenes such as linear low density polyethylene, polypropylenes, polyamides, polyethylene terephthalate and polybutylene terephthalate. A lubricant layer is a soft plastic layer which easily deforms and lubricates a cutter in the cutting of the barrier layer and the seal layer. These can be a polyene such as polyethylene or polypropylene.

DETAILED DESCRIPTION OF THE INVENTION

Figure 1:
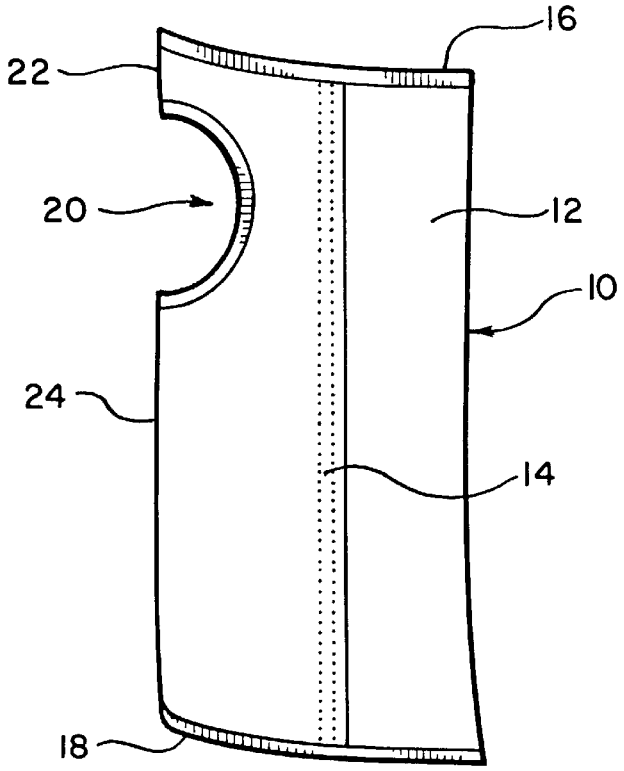
FIG. 1 is a prior art pouch with an overlap seal on a rear surface.

The present pouch package is an improvement over prior art pouch packages. In FIG. 1 there is shown a prior art pouch 10 that has a rear surface 12 with a longitudinal overlap seal 14. The pouch has a top edge 16 and a lower edge 18. Adjacent the top edge is recess 20 which defines a spout 22. This spout is in side 24 of the pouch. The lower edge and the upper edge are comprised of inner layer to inner layer fin seals.

Figure 2:
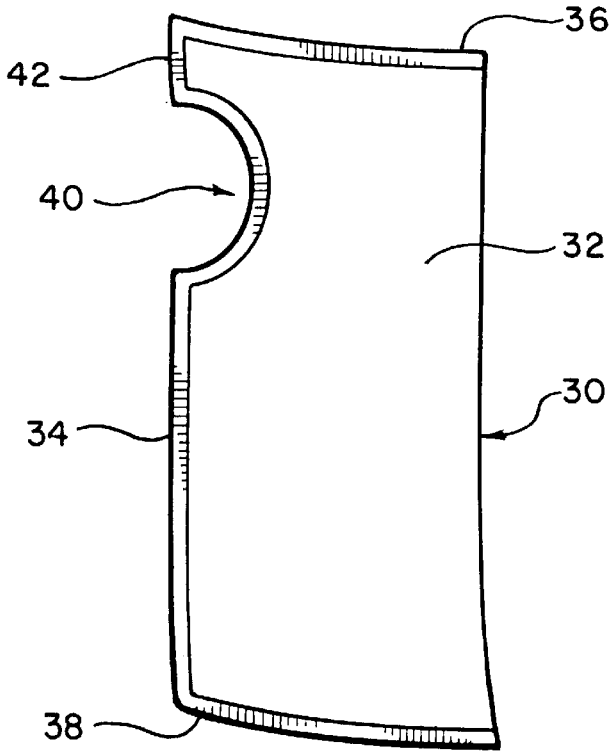
FIG. 2 is a pouch that has a fin seal on a side surface of the pouch.
Figure 3:
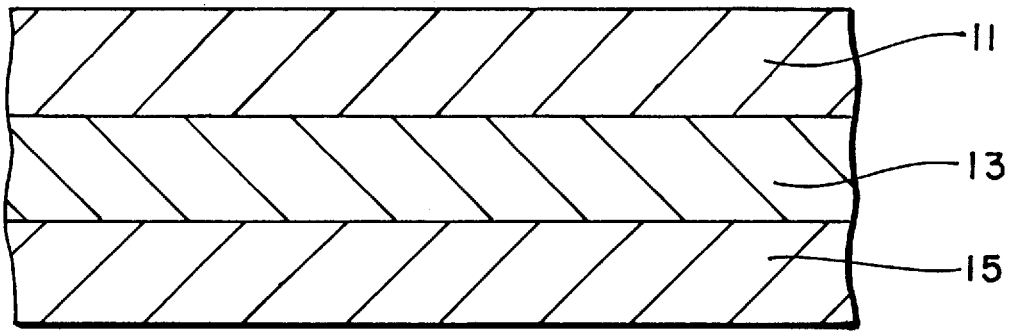
FIG. 3 is a cross-sectional view of the pouch film.
Figure 4:
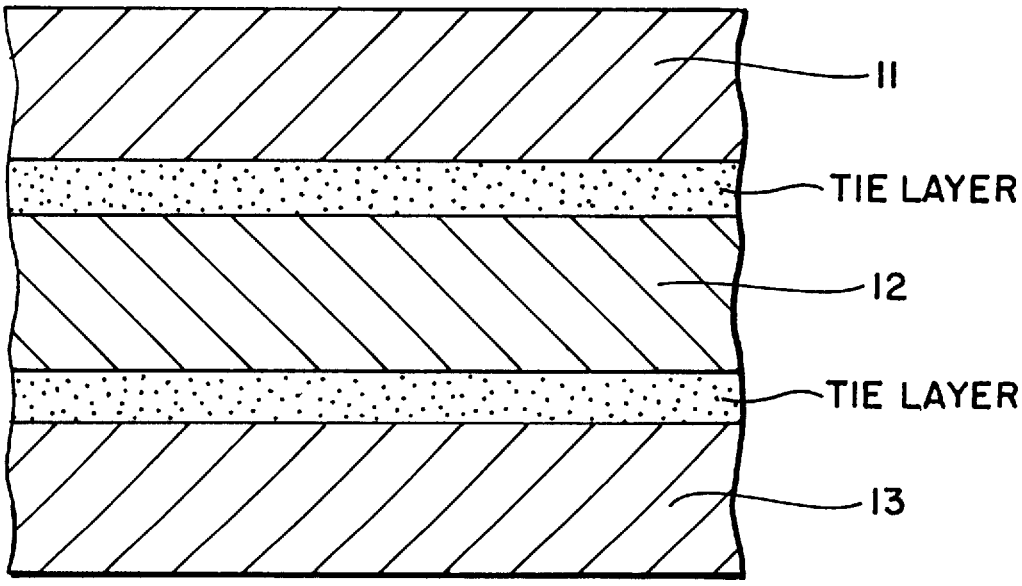
FIG. 4 is a cross-sectional view of the pouch film showing adhesive tie layers.

FIG. 2 illustrates a pouch 30 of the present invention. This pouch has rear surface 32 and inner layer to inner layer longitudinal fin seal 34. The top edge 36 and lower edge 38 also are inner layer to inner layer fin seals. Below the lower edge is recess 40 which forms a spout 42. This pouch can be of a volume size of 50 ml to 2000 ml or larger.

The pouch is comprised of an inner seal layer 11 with an adjacent barrier layer 13. In addition adjacent the other surface of the barrier layer there can be a lubricant or other such layer. The seal layer will be a layer that absorbs RF energy and softens. This softened layer upon the application of pressure is bonded to itself. The barrier layer will provide a gas, moisture and/or organic barrier. The seal layer will also have barrier properties, usually for moisture.

A lubricant layer 15 will lubricate a severing edge of a cutter that is used to sever a fully formed pouch from an adjacent tubular member. This decreaces the wear on the cutter. Suitable lubricant layers are comprised of polyenes such as polyethylene and polypropylene.

The seal layer can be comprised of may different polymers and copolymers. There can be ethylene vinyl acetate copolymers and acrylic acid copolymers such as ethylene acrylic acid copolymers and methacrylic acid copolymers. The barrier layer can be a polyethylene polymer or copolymer, a polypropylene polymer or copolymer, polyamides, polyethylene terephthalates and polybutylene terephthalates. Useful polyethylene polymers are linear low density polyethylenes.

The film multilayer will have a thickness of about 120 microns to about 400 microns, and preferably about 180 microns to 320 microns. The seal layer will have a thickness of about 10 microns to about 80 microns, and preferably about 15 microns to about 50 microns. The barrier layer will have a thickness of about 20 microns to about 100 microns, and preferably about 30 microns to about 70 microns. There also can be adhesive tie layers between the seal layer and barrier layer and the barrier layer and lubricant layer. Such a tie layer will have a thickness of about 5 microns to about 15 microns, and preferably about 10 microns.

The pouch packages are made and filled in a continuous from/fill technique. A multilayer film is formed into a tubular form and sealed along the longitudinal edges by an inner layer to inner layer fin seal to form a tubular member. This fin seal can be on essentially any surface of the pouch, and preferably is on a side edge. This is usually on the side edge that has the spout.

After the tubular member has been formed and sealed a lower end is sealed to form an open pouch. This is a fin seal. The pouch then is filled with a product and the other end sealed to form a closed pouch. The filled and sealed pouch then is severed from the tubular member and case packed for shipment for sale.

The present pouch package has been described in the preferred embodiments. However, the pouch packaged can be modified in various ways but yet be within the pouch package of the present invention.

EXAMPLE 1

A 150 micron coextruded film is formed having a seal layer, a barrier layer and a lubricant layer. The seal layer is an ethylene vinyl acetate layer. The vinyl acetate content is 22 percent. The barrier layer is adjacent the seal layer and is a linear low density polyethylene. Adjacent the other barrier layer surface is a lubricant layer containing ethylene vinyl acetate and linear low density polyethylene. The seal layer is 95 microns thick, the barrier layer 40 microns and the lubricant layer 15 microns. All layers of the pouch contain 8 percent $Ti0_2$ to opacify the multilayer film. The pouch is formed in a form/fill operation where the film is fed to a shaper which shapes the film to a tubular shape. A longitudinal seal is then formed by RF energy with an inner edge to inner edge contact of the film. The film then moves downward and a lower seal is formed on the tubular shape that has just had a longitudinal seal formed to form a tubular member. The recess and spout are formed in this operation. The pouch is then filled with bleach and moved downward. An upper seal then is formed and the closed pouch severed from the adjoining tubular member that is to be filled. The pouch has good seal and burst strengths.

EXAMPLE 2

A coextruded film is produced where the barrier layer is nylon having a thickness of 150 microns. The seal layer is a 60 micron ethylene vinyl acetate inner layer. The outer lubricant layer is comprised of a 45 micron layer of an ethylene vinyl acetate copolymer and linear low density polyethylene mixture. The nylon barrier layer has a thickness of 15 microns. On each side of the nylon layer is an adhesive tie layer. This adhesive tie layer is an ethylene vinyl acetate functionalized with amide groups. Optionally a polyethylene functionalized with amide groups can be used. The tie layers are 10 microns each. Each layer contains 8 percent $Ti0_2$ to make the film opaque. Pouches that are made from this film using the same form/fill technique as described in Example 1 and formed into pouches. The pouches have good seal and burst strengths.

We claim:

1. A flexible pouch package comprising a multilayer film of at least three layers of plastic material bonded together, a first layer readily bondable to itself through the application of radio frequency energy and bonded to one side of a second layer, said second layer different from said first layer, a third lubricant layer comprising a polyene and ethylene vinyl acetate bonded to another side of said second layer to facilitate cutting said multilayer film, said multilayer film in the form of an elongated tubular shape having longitudinal edges, the longitudinal edges of said tubular shape bonded together to form a longitudinal seal through the contact of said first layer to said first layer by the application of radio frequency energy to form a tubular member.

2. A flexible pouch package as in claim 1 wherein all seals comprise a seal of first layer to a first layer.

3. A flexible pouch package as in claim 1 wherein the first layer is comprised of ethylene vinyl acetate wherein the vinyl acetate content is about 18 to 28 percent by weight.

4. A flexible pouch package as in claim 1 wherein said polyene is selected from the group consisting of polyethylene and polypropylene.

5. A flexible pouch package as in claim 1 wherein said second layer is a barrier layer and is selected from the group consisting of polyamides, polyethylene, polypropylene, polyethylene terephthalate and polybutylene terephthalate.

6. A flexible pouch package as in claim 1 wherein said first layer is comprised of ethylene acrylic acid copolymers.

7. A flexible pouch package as in claim 6 wherein said first layer is a methacrylic acid copolymer.

8. A flexible pouch package as in claim 1 wherein said film layers have a thickness of about 180 to about 320 microns.

9. A flexible pouch package as in claim 8 wherein said seal layer has a thickness of about 10 microns to about 80 microns and said barrier layer has a thickness of about 20 microns to about 100 microns.

10. A flexible pouch package as in claim 1 wherein there is an adhesive tie layer between said first layer and said second layer.

11. A flexible pouch package as in claim 1 wherein there is an adhesive tie layer between said second layer and said third lubricant layer.

12. A flexible pouch package as in claim 1 wherein there is an adhesive tie layer between said first layer and said second layer and an adhesive tie layer between said second layer and said third lubricant layer.

* * * * *

UNITED STATES PATENT AND TRADEMARK OFFICE

CERTIFICATE OF CORRRECTION

PATENT NO. : 5,806,983
DATED : Sept. 15, 1998
INVENTOR(S) : Millon, et al.

It is certified that error appears in the above-identified patent and that said Letters Patent is hereby corrected as shown below:

On the title page, under item [56], References Cited, insert the following:

U. S. PATENT DOCUMENTS

| EXAMINER INITIAL | | PATENT NUMBER | | | | | | | ISSUE DATE | PATENTEE | CLASS | SUBCLASS | FILING DATE IF APPROPRIATE |
|---|---|---|---|---|---|---|---|---|---|---|---|---|---|
| | | 3 | 0 | 8 | 3 | 8 | 7 | 6 | 4/2/63 | W.S. Schneider et al | | | |
| | | 4 | 6 | 2 | 5 | 4 | 9 | 6 | 12/2/86 | Ausnit | | | |
| | | | | | | | | | | | | | |

UNITED STATES PATENT AND TRADEMARK OFFICE

CERTIFICATE OF CORRRECTION

PATENT NO. : 5,806,983
DATED : Sept. 15, 1998
INVENTOR(S) : Millon, et al.

It is certified that error appears in the above-identified patent and that said Letters Patent is hereby corrected as shown below:

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 0 | 4 | 7 | 1 | 6 | 0 | 7 | 2/19/92 | European | | | | |
| | | 0 | 3 | 8 | 9 | 2 | 5 | 8 | 9/26/90 | European | | | | |
| | | | | | | | | | | | | | | |

Signed and Sealed this

Thirteenth Day of April, 1999

*Attest:*

Q. TODD DICKINSON

*Attesting Officer*

*Acting Commissioner of Patents and Trademarks*